United States Patent [19]

Elvidge et al.

[11] 4,274,812

[45] Jun. 23, 1981

[54] JET PUMP

[76] Inventors: John H. K. Elvidge; Charles J. Watkinson, both of 1 Brown Pl., Brown Lane Industrial Estate, Leeds 11, Yorkshire, England

[21] Appl. No.: 965,582

[22] Filed: Dec. 1, 1978

[51] Int. Cl.[3] ..... F04F 5/46

[52] U.S. Cl. ..... 417/179; 239/433; 239/543; 417/198

[58] Field of Search ..... 239/543, 433; 417/179, 417/198, 151, 169, 178, 180

[56] References Cited

U.S. PATENT DOCUMENTS

| | | | |
|---|---|---|---|
| 57,035 | 8/1866 | Barnes | 417/179 |
| 749,050 | 1/1904 | Fraser | 417/179 |
| 830,085 | 9/1906 | Land | 417/179 |
| 889,713 | 6/1908 | McClave | 417/179 |
| 985,415 | 2/1911 | John . | |
| 1,264,116 | 4/1918 | Moss . | |
| 1,318,750 | 10/1919 | Hawkesworth . | |
| 1,549,353 | 8/1925 | Ehrhart | 417/179 X |
| 2,111,266 | 3/1938 | Hopkins | 417/179 |
| 2,387,708 | 10/1945 | Arnhym | 417/198 X |

FOREIGN PATENT DOCUMENTS

| | | |
|---|---|---|
| 2422785 | 1/1975 | Fed. Rep. of Germany . |
| 847500 | 9/1960 | United Kingdom . |
| 1031796 | 6/1966 | United Kingdom . |
| 1121703 | 7/1968 | United Kingdom . |
| 1343943 | 1/1974 | United Kingdom . |
| 1447523 | 8/1976 | United Kingdom . |
| 1448017 | 9/1976 | United Kingdom . |

*Primary Examiner*—Carlton R. Croyle
*Assistant Examiner*—Edward Look
*Attorney, Agent, or Firm*—Brisebois & Kruger

[57] ABSTRACT

In a jet pump suitable for pumping liquids, gases, or particulate solids, the primary and secondary flows both pass through the pump in-line, i.e. in the same axial direction. This is achieved by mounting the nozzle head (from which the primary flow issues) at one end of a streamlined body which is suitably supported in the mixing chamber. The suction hose opens directly onto the other end of the body. The whole of the primary flow passes through the streamlined body, so that the secondary flow is sucked over the streamlined body and entrained by the primary flow.

The primary flow may issue from a single nozzle at the downstream end of the streamlined body. Alternatively several jets may issue from a ring of nozzles and also from a further nozzle in the center of the ring, all the nozzles being so angled that several jets converge downstream of the nozzle head.

3 Claims, 7 Drawing Figures

JET PUMP

FIELD OF THE INVENTION

The invention relates to jet pumps, which are basically high-vacuum suction cleaners suitable for industrial uses such as cleaning out the insides of large tanks which have been grit-blasted, lifting grain in bulk from a ship's hold or a storage tank, and lifting and pulverising large "rocks" of used foundry sand or relatively soft brick.

REVIEW OF THE PRIOR ART

Known forms of jet pump which are suitable for the purposes outlined above comprise a suction tube, having an inlet for whatever material is to be lifted by the pump, and whose outlet enters a barrel-like "mixing chamber" into which opens an inlet for a jet of high pressure fluid. The suction tube enters the mixing chamber at right angles to the high-pressure jet. The jet itself flows straight through the mixing chamber and out along an outlet tube which leads off the mixing chamber and which forms an axial extension of the chamber. In use, the flow of high pressure fluid into the mixing chamber and along the outlet tube produces a suction effect at the suction tube inlet, so that the material which is to be lifted by the pump is sucked along that tube, into and through the mixing chamber, and along the outlet tube by the entraining action of the jet.

Jet pumps characterised by these known basic design features have proved very useful for heavy industrial suction cleaning applications. They are simple in construction, they have no relatively moving parts, and so they compete successfully with rotary mechanical vacuum pumps, which are expensive to buy and repair, incorporate certain parts which wear relatively quickly, and whose vacuum-generating capacity is limited by the difficulty of sealing the relatively rotating parts of the pump.

U.K. Pat. No. 1,171,159 (Wakefield) illustrates a typical example of a known jet pump.

The known designs of jet pump briefly outlined above have however at least two drawbacks. Firstly, because the lifted solids enter the mixing chamber at right angles to the high-pressure entraining fluid jet, the solids are inevitably decelerated as they are turned through a right angle and entrained into the fluid stream, and must then be accelerated again between the mixing chamber and the pump outlet: this absorbs power, lowers through-put, and makes the pump less efficient than it could be. Secondly, a proportion of solids entering the mixing chamber inevitably "misses" the entraining fluid jet and builds up in the bottom of the chamber, from whence it is gradually entrained into the outgoing fluid jet: this again tends to reduce through-put, and also gradually wears the bottom of the mixing chamber where the solids accumulate.

There is therefore much room for improvement in jet pump design. Those active in the field have recognised this for some years, but in the main they have left the basic working principles unquestioned and have concentrated on trying to optimise the design of the nozzle from which the primary jet issues. The aerodynamics of flow through nozzles, esepcially supersonic flow as in a solids-moving jet pump, is a highly advanced and expensive study, and at least one current designer has spent a great deal of time and money computer-optimising a nozzle design which still only gives a small increase in pump performance.

SUMMARY OF THE INVENTION

We have found that, by radically altering the basic and hitherto unqestioned overall design of the jet pump, the efficiency of the pump can be improved to a level which increases the vacuum generated to levels significantly higher than those of the basic known design and far in excess of those attainable with conventional rotary mechanical vacuum pumps. The same radical design alterations make our jet pump much less susceptible to rapid wear in the region of the mixing chamber when used to lift solids. Our design does this without sacrificing any of the advantages of the overall jet pump concept.

Basically, we achieve this improved design of jet pump by sending the incoming secondary flow of lifted material into the mixing chamber in the same direction as the flow of high-pressure fluid—the "primary flow'-'—which generates the suction effect of the pump, rather than turning it through 90° as in the known design. To do this, we mount the jet nozzle in a body which is so supported in the mixing chamber, and so profiled, that the incoming secondary stream of lifted material flows over its surface as it is entrained through the mixing chamber by the primary jet. The secondary stream is thus progressively accelerated all the way through the pump, instead of having to recover from the 90° turn of conventional designs.

This new concept is equally applicable to pumps which are to be used as vacuum pumps—i.e. to pump liquids and gases—or to pumps which are to be used to lift solids such as grit or grain. In either case, but particularly the latter case, we prefer to incorporate into the underside of the nozzle-holding body a curved surface, underneath which the incoming secondary stream of solids flows and which is curved so as to "lift" the flow of solids off the bottom wall of the mixing chamber and into the outlet tube which leads off the chamber. This "lifting" of the solids flow into the outlet tube greatly reduces the wear on the bottom wall of the mixing chamber, and the entrance region of the outlet tube, which tended to occur with conventional jet pumps.

It is possible to achieve this significantly increased vacuum and through-put in a jet pump embodying our invention, by using a straightforward single-jet nozzle and without having to investigate the relatively complex field of nozzle design at all. In an effort to increase performance still further, however, we have investigated nozzle design also. Known solids-moving jet pumps almost always use a single-jet nozzle. It is known that if several jets issue from a ring of nozzles which are angled so that the jets converge, the entraining effect is greater than that of a single jet, but this does not lend itself readily to adaption in a solids-moving jet pump. U.S. Pat. No. 1,264,116 for example shows a multiple-nozzle arrangement in an otherwise conventional jet pump, but this is specifically stated to be for use in pumping fluids: it could never function successfully as a solids-moving pump, because the multiple nozzle heads would be positioned straight in the path of the incoming high-velocity solids and would rapidly be destroyed.

We have found that if the jets from a ring of nozzles converge onto the axis of a further jet issuing from the centre of the ring, the resultant combined jet takes longer to diffuse and the suction effect is significantly increased. Because the incoming secondary stream in our jet pump is deliberately sent over the body incorporating the nozzle head, this multiple-jet concept can be incorporated into our pump without difficulty. In addition, the extra "pull" of the converged jets allows the nozzle head to be positioned far enough back from the mixing chamber outlet to minimise any danger of damage to it as the solids are "lifted" into the outlet tube.

Where such a ring of nozzles is used, the performance can be increased still further by forming a channel in the nozzle head between each individual nozzle and the one next to it. Thus, a seven-nozzle ring would have seven such channels each forming a gap in the material between two circumferentially successive nozzles. In use, the jets issuing from the nozzles entrain fluid down these channels and into the resultant combined primary jet. This increases the cross-sectional area of the primary jet and raises the through-put of the pump.

A single primary jet of high pressure fluid may be fed into a nozzle head in which a plurality of nozzles are formed, the jet entering the head and impinging against a face from which the nozzles each lead off. If the face is dished concavely, the flow of air into the individual nozzles is assisted, reducing turbulence in the individual nozzle throats and smoothing the outflow of the individual jets. This again optimises the pump performance.

The mixing chamber in known jet pumps normally converges into the outlet tube, but the outlet tube itself is usually just a parallel-walled tube. In our design, for optimum efficiency, the convergence is preferably accomplished by way of a smoothly profiled transition zone and the outlet tube takes the form of a relatively long section whose bore diverges progressively but gradually along its length. The outlet tube and the transition zone then effectively form a convergent-divergent nozzle with a very long divergent section which will tend to accelerate to a maximum the combined primary and secondary flows emerging from the mixing chamber. A two-stage divergence gives even better performance.

In conventional solids-moving jet pumps, the nozzle head is positioned as far back as possible from the secondary stream inlet, to keep it well out of the way of the incoming stream of high-velocity abrasive solids. This however means that the point at which the entraining jet beings to diffuse, and lose its suction power, is also moved farther back from the pump outlet. In our design, the opposite is true: the nozzle head can be positioned well forward in the mixing chamber, and the secondary stream is accelerated fully through to the outlet of the pump.

The body incorporating the nozzle head is preferably streamlined so as to present the minimum resistance to the incoming secondary flow. The flow could, for example, pass wholly around the body and be entrained from all sides by the stream of fluid issuing from the nozzle. It is, however, within the broad scope of the invention for the secondary flow to pass wholly over or under the surface of said body and to be "pulled" into line, downstream of the nozzle, by the stream of high-pressure fluid issuing from the nozzle. In that case, only the flow surface of the nozzle body need be streamlined.

We mentioned above that the flow surface of the nozzle body could be curved suddenly inwards to "lift" solids into the outlet tube. Even when the pump does not lift solids, if the nozzle body curves inwards (i.e. towards the line of the primary jet) at its downstream end, the secondary flow over the body experiences a "ram" effect which accelerates it into the outlet, and the entraining of the secondary flow by the jet is assisted.

Thus, each and every one of the inventive features outlined above materially increases the pump performance. A jet pump embodying all these features is illustrated in the accompanying drawings, and will now be described, and it will become apparent from this description that the cumulative effect of the design features outlined above raises the performance of such a pump to a level which is far in excess of that attainable with conventional jet pumps.

DESCRIPTION OF THE PREFERRED EMBODIMENTS

Figure 1:
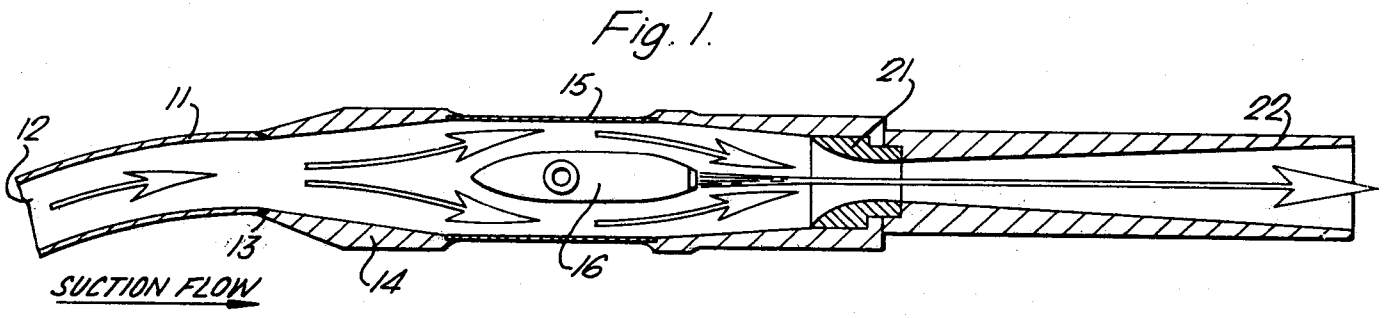
FIG. 1 shows in sectioned side elevation a fluid lifting jet pump embodying the invention.
Figure 2:
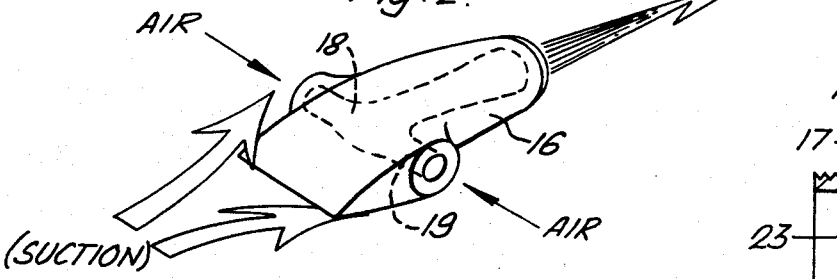
FIG. 2 shows in perspective the nozzle-containing body of the pump.

Referring first to FIGS. 1 and 2 of the drawings, a flexible and relatively large-diameter suction tube 11 has one end 12 open for connection to a source of liquid or gas which the pump is to transport. The other end 13 of the tube 11 is releasably connected, for example by a circular metal strap and clip, or (as shown) by a releasable threaded union 14, to the inlet of the mixing chamber 15 of the pump. The suction tube 11 enters the mixing chamber 15 in line with the longitudinal axis of the chamber, and the union 14 through which the tube is screw-threaded releasably to the mixing chamber has an interior bore which diverges smoothly into the interior of the chamber.

A torpedo-like body 16 is secured in the interior of the mixing chamber. The longitudinal axis of the body lies on the longitudinal axis of the circular-cylindrical mixing chamber, and the body is made of a hard plastics material. One suitable material is that available commercially under the trade name DELRIN, which is a high-impact polypropylene and can be easily machined and therefore reamed and threaded accurately. This is particularly important, since the threads used on a jet pump will usually be in accordance with standard pipe-threading measurements and will have a relatively fine thread.

The torpedo-like body 16 presents a streamlined end to the suction tube. Its other end is also streamlined, but has a nozzle head 17 screw-threaded into it. The nozzle head 17 is shown in detail in FIGS. 3 and 4, and will be described later.

Initially separate jets of high pressure compressed air are led into channels 18, 19 formed in the torpedo-like body 16. These channels 18, 19 converge, to present a single stream of air to the nozzle head 17. The nozzle head has multiple nozzles, so that the single incoming stream of high pressure air emerges in several jets. The jets converge downstream of the nozzle head 17 onto the axis of a further, central, jet to form the final combined primary stream of fluid which generates the suction effect of the jet pump.

As FIG. 1 shows, the mixing chamber 15 is in two circular-cylindrical co-axial parts which are screw-threaded together. If the front part is unscrewed from the rear part, access to the nozzle head 17 is gained without having to removed the body 16 from the mixing chamber.

A cylindrical insert made of the DELRIN material previously referred to is screwed into the front of the mixing chamber 16. This insert, referenced 21 in FIG. 1, has a convergent interior which is smoothly profiled and which forms a transition zone from the mixing chamber 15 into a circular-cylindrical outlet tube 22 which is screw-threaded to the front of the insert 21. It will be seen from FIG. 1 that the interior of the outlet tube 22 gradually diverges, and the outlet tube 22 thus forms with the insert 21 effectively a convergent-divergent nozzle.

The outlet tube 22 is relatively long. In this particular example, the entrance to the transition zone defined by the insert 21 is 78 mm; the transition zone then converges to 39 mm diameter and stays parallel for approximately 60 mm to the end of the insert 21; and then diverges on an axial taper of 1½° (i.e. 3° on diameter) over approximately 560 mm length of the outlet tube 22 to a final diameter at outlet of 68 mm.

Figure 3:
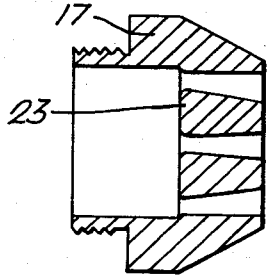
FIG. 3 shows a nozzle head in a sectional view taken along line 3—3 of FIG. 4.
Figure 4:
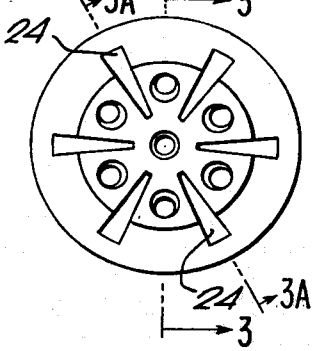
FIG. 4 shows the head of FIG. 3 in end elevation.

Referring now to FIGS. 3 and 4, the nozzle head 17 is machined from suitably wear-resistant metal and is screw-threaded into the forward end of the torpedo-like body 16. One end of the nozzle head 17 opens as an inlet for the single high pressure stream which enters the nozzle head, and this stream impinges on to a face 23 which is concavely dished and from which the individual nozzles lead off. Each nozzle is of convergent-divergent form and has a 1½° axial taper (i.e. 3° across its diameter) along the divergent portion of its length.

FIG. 4 shows the pattern in which the individual nozzles are arranged in the nozzle head. There is a ring of six nozzles each equally circumferentially spaced from one another and all spaced at an equal radial distance from a seventh central nozzle. All the nozzles are so angled through the head that the seven individual jet streams which emerge from the head come together at a point downstream of the head.

Open-topped channels 24 are cut into the nozzle head 17. Each such channel forms a gap in the material between two circumferentially successive individual nozzles. All the channels extend along the nozzle head 17 when the head is viewed axially, and extend radially of the nozzle head by equal amounts when viewed as in FIG. 4. The base of each channel is angled steeply downwards towards the central axis of the nozzle head 17, so that each channel basically defines an open-topped isosceles triangle cut out from the nozzle head.

In use, initially separate streams of high pressure air are led through the channels 18, 19 in the torpedo-like body 16 to impinge on the concavely dished face 23 of the nozzle head 17. Individual jets emerge from the ring of nozzles and the central nozzle in the nozzle head 17, and converge into a single primary entraining jet downstream of the nozzle head. This generates a suction effect through the mixing chamber 16, the union 14, down to the inlet of the suction tube 11. The liquid or gas which is to be lifted by the pump is pulled up the suction tube 11, into and through the mixing chamber 15 and over and around the body 16, and accelerated out of the pump through the convergent-divergent nozzle defined by the insert 21 and the outlet tube 22.

Figure 5:
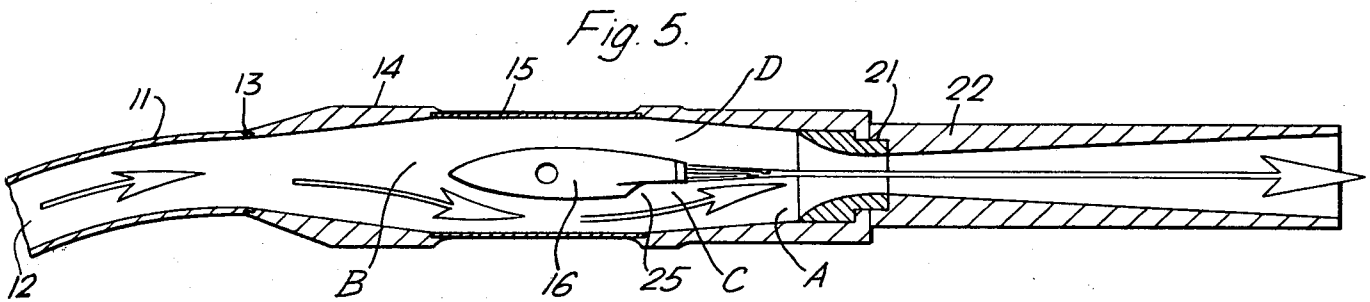
FIG. 5 shows in sectioned side elevation a solids-lifting jet pump embodying the invention.
Figure 3A:
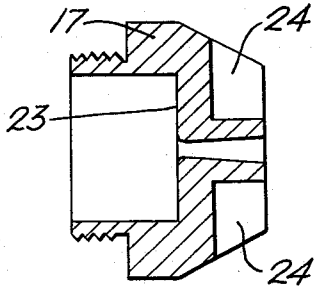
FIG. 3A shows the nozzle head in a sectional view taken along line 3A—3A of FIG. 4.
Figure 6:
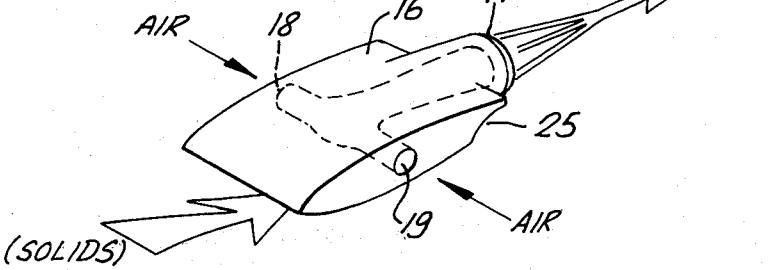
FIG. 6 shows in perspective the nozzle-containing body of the pump of FIG. 5.

The pump shown in FIGS. 5 and 6 is of basically similar construction, and corresponding parts have been given the same reference numerals as in FIGS. 1 and 2. The construction of the nozzle head 17 of this pump is identical to that just described, with reference to FIGS. 3 and 4. The pump of FIGS. 5 and 6 however is intended to lift particulate solids such as grain from storage tanks, grit from the insides of tanks which have been grit-blasted, and large "rocks" of used foundry sand or other fragments which are first drawn up the suction tube 11 and then pulverised as they pass through the mixing chamber 15 before being ejected from the outlet 22 of the pump in a fine dust.

In order to do this, the body 16 of the pump is altered. It is given a basically aerofoil shape, as shown in FIG. 6, but the bottom surface of the aerofoil is concavely-curved at its forward end upwardly and towards the converging entry section of the insert 21. The concave curving section is indicated at 25 in FIG. 6.

In use, the primary jets issue from the nozzle head 17 as previously described and generate a suction effect through the pump. This draws the solid material up the suction tube 11 and into the mixing chamber 15.

The bulk of the solids transported through the body of the pump tend to be in the lower sector due to gravitational forces. In order to stop the solids from queueing or accumulating at point "A" it is necessary to: 1. Lift the particles into line with the venturi; and 2. Increase the flow of air over the top of the aerofoil, in turn increasing the proportion of solid particles drawn into the upper chamber which can then pass into the venturi throat, assisted by gravity. This is achieved by the aerofoil like shape. The airflow along the lower passage tries to follow the sudden concavity 25 in the tail section thus causing a "dead air" area at point "A" and thus causing the solids to be lifted towards the venturi throat. At the same time a reduction in pressure is created at zone "C," allowing the air to zone "D," now at a higher, i.e. more negative, pressure, to move at a higher speed into the venturi area. This creates a higher flow of air over the top of the venturi than over the bottom, taking a larger number of the heavier solids through the top passage at point "B," assisting in equalizing solids flow in the upper and lower chambers and speeding entry into the venturi throat.

Correspondingly, while a majority of solids initially pass underneath the aerofoiled body 16, the sudden concavity 25 is encountered. The concavity provides the "ram" effect which lifts the solids, including any solids accumulated in the region A into the convergent entry of the insert 21, rather than impinging the solids directly on the profiled surface of the insert.

Using a pump of the kind just described, we have achieved vacuum of approximately 19" of mercury, with a secondary flow of approximately 350 cfm using 220 cfm primary flow at 100 psi. This is far in excess of flow/vacuum figures attained with conventional jet pumps.

In both of the pumps illustrated, flow of the primary jets through the nozzle head 17 is supersonic in order to generate these very high vacuums and (in the pump of FIGS. 5 and 6) to lift particulate solid materials in bulk and with maximum throughput.

As shown in FIGS. 1, 2, 5 and 6, the suction inlet diverges through the union 14 into the interior of the mixing chamber 15, and the mixing chamber interior subsequently converges towards the profiled interior of the insert 21 which leads into the discharge tube 22.

We claim:

1. A jet pump comprising a cylindrical open-ended hollow chamber having a suction inlet at one end and a discharge tube at the opposite end; a streamlined body mounted in the chamber, with one end facing the suction inlet and the opposite end facing the discharge tube; a nozzle head situated at that end of the body which facs the discharge tube and with its discharge directed along said tube; a duct extending into the body through the wall of the chamber and communicating with the nozzle head; means to couple a primary flow of high-pressure fluid to the inlet of the duct; and means to couple a suction tube to the suction inlet of the chamber; the arrangement being such that, in use, the high-pressure primary fluid flow issuing from the nozzle and along the discharge tube will entrain material into and along the suction tube, over the streamlined surface of said body, and out along the discharge tube, in which the nozzle head incorporates multiple nozzles arranged in a ring around a central nozzle, and the nozzles are so angled in the head that the initially separate streams of high-pressure fluid which they discharge all converge downstream of the nozzle head, and in which channels are formed in the nozzle head between each nozzle and the circumferentially succeeding one, along which channels fluid can be entrained into the streams issuing, in use, from the nozzles.

2. A jet pump according to claim 1, in which a single stream of high-pressure fluid enters the nozzle head along said duct and impinges against a concavely-dished face from which the individual nozzles lead off.

3. A jet pump according to claim 1, in which the said body is mounted centrally and longitudinally of the cylindrical chamber so that the entrained material flows over and around its entire outer surface.

* * * * *